US005821485A

United States Patent [19]

Singer et al.

[11] Patent Number: 5,821,485

[45] Date of Patent: Oct. 13, 1998

[54] CIRCUIT BREAKER ELECTRONIC TRIP UNIT WITH ADJUSTABLE SETTINGS

[75] Inventors: Paul H. Singer, West Hartford; Paul T. Rajotte, Plainville, both of Conn.

[73] Assignee: General Electric Company, New York, N.Y.

[21] Appl. No.: 842,951

[22] Filed: Apr. 25, 1997

[51] Int. Cl.[6] ..... H01H 71/74

[52] U.S. Cl. ..... 200/17 R

[58] Field of Search ..... 200/17 R, 286, 200/293, 303, 308; 218/1; 307/126, 132 E, 140; 335/18, 132, 176, 202; 337/360; 361/91, 93, 96, 97, 42, 41, 642, 643, 680, 683, 787; 365/201

[56] References Cited

U.S. PATENT DOCUMENTS

| | | | |
|---|---|---|---|
| 3,593,234 | 7/1971 | Charbonneau et al. | 335/176 |
| 3,831,120 | 8/1974 | Powell et al. | 335/176 |
| 3,975,701 | 8/1976 | Hendry et al. | 335/176 |
| 4,351,012 | 9/1982 | Elms et al. | 361/96 |
| 4,649,455 | 3/1987 | Scott | 361/93 |
| 4,672,501 | 6/1987 | Bilac et al. | 361/96 |
| 4,870,531 | 9/1989 | Danek | 361/93 |
| 5,027,091 | 6/1991 | Lesslie et al. | 335/132 |
| 5,204,798 | 4/1993 | Scott | 361/93 |
| 5,467,069 | 11/1995 | Payet-Burin et al. | 335/176 |

*Primary Examiner*—Michael A. Friedhofer
*Attorney, Agent, or Firm*—Richard A. Menelly; Carl B. Horton

[57] ABSTRACT

A circuit breaker trip unit enclosure is adapted to receive rotary knobs that are limited in rotation in proportion to the circuit breaker short circuit rating. The externally-accessible rotary knobs extend within the enclosure to contact with a potentiometer affixed to the circuit breaker trip unit printed circuit board. A stop member is inserted within the enclosure access opening to detent the rotary knob shank that extends through the access opening.

13 Claims, 3 Drawing Sheets

CIRCUIT BREAKER ELECTRONIC TRIP UNIT WITH ADJUSTABLE SETTINGS

BACKGROUND OF THE INVENTION

Circuit Breakers having electronic trip units are described in U.S. Pat. No. 4,672,501 entitled "Circuit Breaker and Protective Relay Unit". Such trip units often include a keypad along with a display for accessing the processor and for entering and changing the trip unit settings.

One such circuit breaker having a keypad and display is described within U.S. Pat. No. 4,870,531 entitled "Circuit Breaker With Removable Display & Keypad".

A circuit breaker having a digital trip unit with external adjustment knobs for entering and changing the trip unit settings is described within U.S. Pat. No. 4,351,012 entitled "Circuit Interrupter with Digital Trip Unit and Means to Enter Trip Settings" and a circuit breaker having an analog trip unit with external adjustment knobs for entering and changing the trip unit settings is described within U.S. Pat. No. 3,831,120 entitled "Trip Unit Having Improved Trip Adjustment Indicator and Circuit Breaker Incorporating Same".

It has been found economically feasible to incorporate digital circuit breakers of smaller frame size with digital trip units using rotary knobs to enter and adjust the circuit breaker trip settings as described above.

One problem with use of a standard digital trip unit over a wide range of ampere ratings is the possibility of using incorrect rotary knobs for setting and adjusting the circuit breaker trip parameters.

The purpose of the invention is to describe a circuit breaker trip unit having rotary knobs that are keyed for each allowing a single circuit breaker trip unit to be used over a wide range of circuit breaker ampere ratings.

SUMMARY OF THE INVENTION

A circuit breaker trip unit enclosure is adapted to receive rotary knobs that are limited in rotation in proportion to the circuit breaker short circuit rating. The externally-accessible rotary knobs extend within the enclosure to contact with a potentiometer affixed to the circuit breaker trip unit printed circuit board. A stop member is inserted within the enclosure access opening to detent the rotary knob shank that extends through the access opening and set the degree of rotation of the knob and the rotation of the associated potentiometer within the trip unit set the circuit breaker instantaneous current rating.

DESCRIPTION OF THE PREFERRED EMBODIMENT

Figure 1:
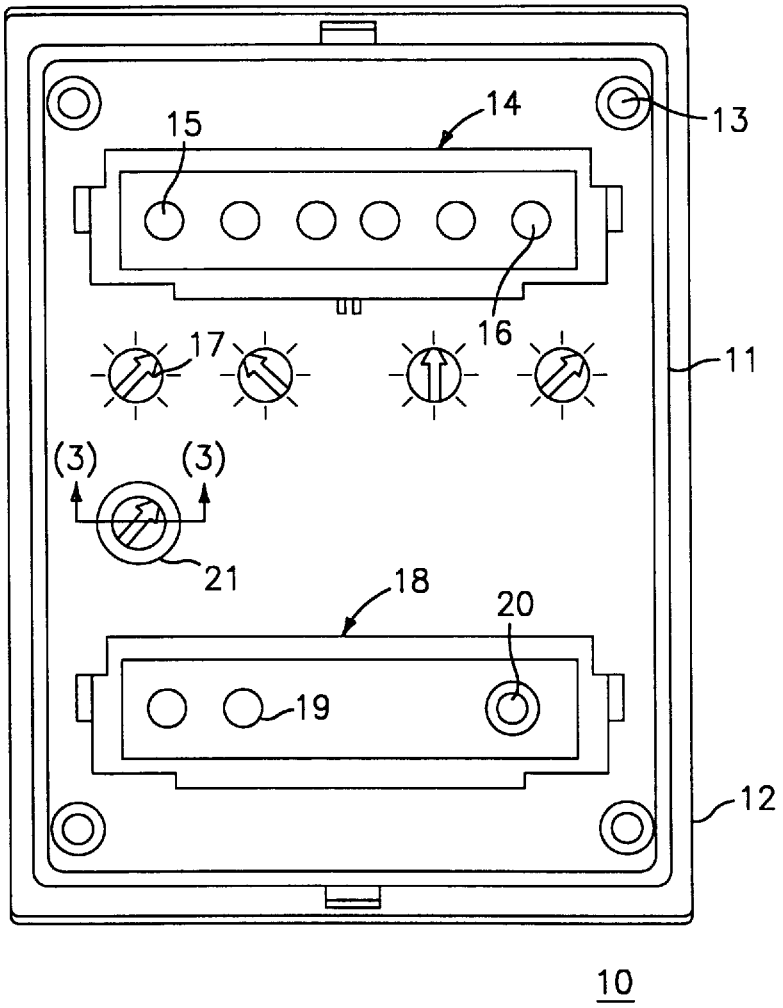
FIG. 1 is a front plan view of a circuit breaker trip unit according to the invention.

A circuit breaker electronic trip unit 10 similar to that used within the circuit breaker described within the aforementioned U.S. Pat. No. 4,672,501 is depicted in FIG. 1 and includes a cover 11 that is attached to a case 12 by means of screws 13. A plug-in indicator unit 14 is employed to display the condition of the contacts within an associated circuit breaker (not shown). Indicating diodes 15 as well as target indicators 16 provide such visual indication to an operator in lieu of the display arrangement described in the aforementioned U.S. Pat. No. 4,870,531. In substitution of the keypad described within this patent, a first set of knobs 17 are used to enter the long time and short time overcurrent protection settings within the trip unit printed circuit board 22 (FIG. 2) while a second knob 21 is used to set the trip unit short circuit ratings. A plug-in type rating plug 18 such as described in U.S. Pat. No. 4,649,455 entitled "Rating Plug for Molded Case Circuit Breaker" and U.S. Pat. No. 5,027,091 entitled "Molded Case Circuit Interrupter Rating Plug Keying and Interlock Arrangement" is used to set the circuit breaker trip unit ampere rating. Switches 19 are used to actuate the trip unit for ground fault determination in the manner described within U.S. Pat. application Ser. No. 08 767,748 entitled "Ground Fault Rating Plug for Molded Case Circuit Breakers" and jack 20 is used for metering and test facility.

Figure 2:
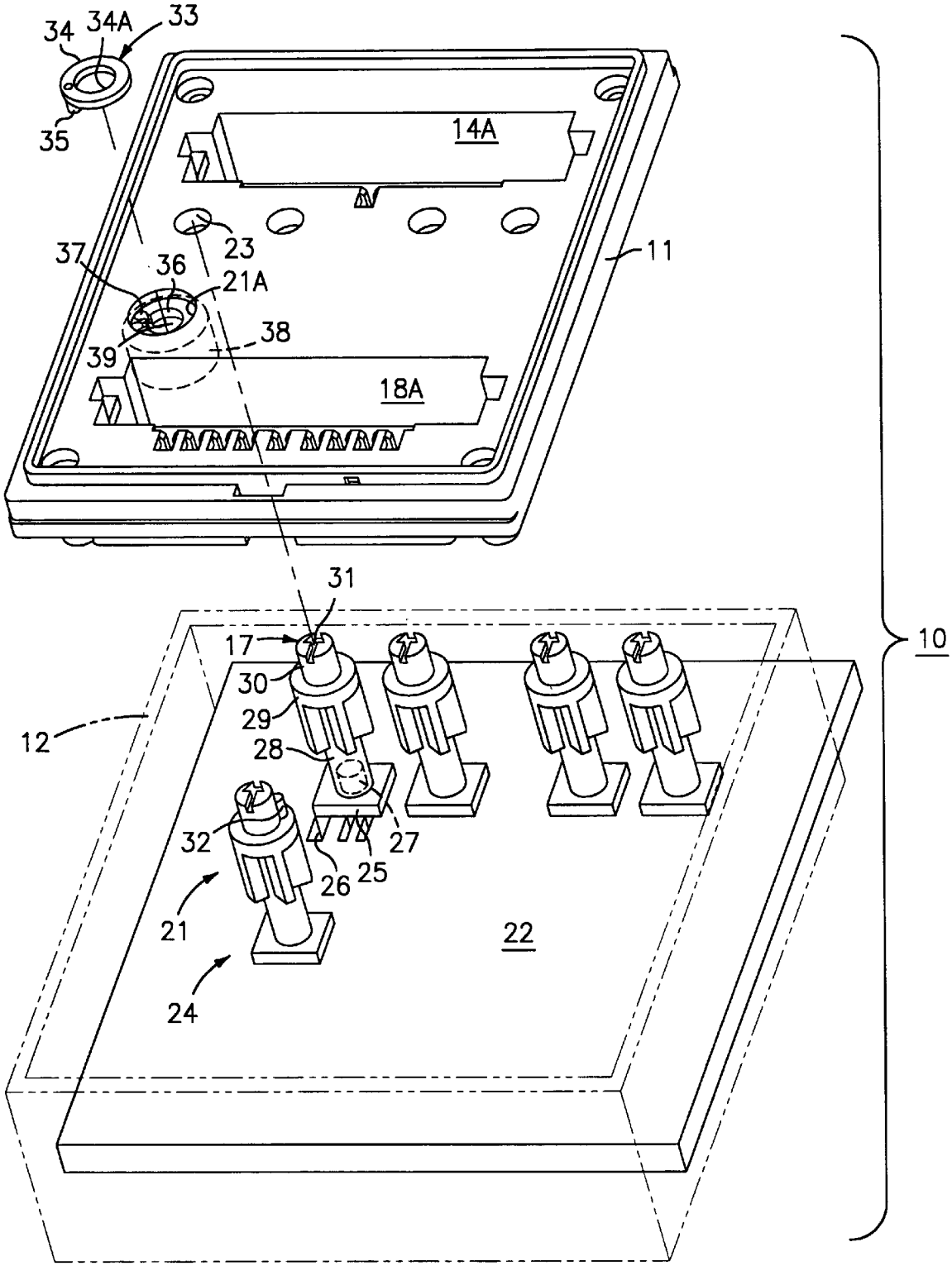
FIG. 2 is a top perspective view of the circuit breaker trip unit of FIG. 1 with the trip unit cover depicted in isometric projection prior to assembly to the trip unit case.

The trip unit 10 is shown in FIG. 2 with the cover 11 prior to attaching to the case 12, depicted in phantom, and with the indicator unit and trip unit removed from their respective recesses 14A, 18A and prior to inserting the knobs within openings 23. The first knobs 17 are formed from a unitary plastic piece defining a barrel 28 at the bottom which is hollow to receive a serrated stem 27, which extends upward from base 25 of the potentiometer 24 that connects with the trip unit printed circuit board 22 by means of terminals 26. A knob stem 30 is formed at the top of the first knob 17 and includes a slot 31 for insertion of a tool. A cylindrical flange 29 extends between the knob stem 30 and the bottom barrel 28 to provide strength to the knob as well as to provide a clearance fit within the cylinder 38 extending from the interior of the cover 11. The second knob 21 is similar to the first knob and further includes a post projection 32 that cooperates with a detent pin 35 extending from the bottom of an annular ring formed within the short circuit current rating ring 33 in the manner to be described below in some detail. The second knob opening 21 A includes a perimetric floor 36 with apertures 37 formed in one side to receive the detent pin 35 and set the rotation extent of the knob stem when the knob stem is projected through the opening 39 formed within the perimetric floor. The opening 34A within the short circuit rating ring 34 captures the top of the knob stem 30 in clearance fit relation to allow the knob stem to rotate therein. The post 32 on the knob stem 30 prevents the knob stem from complete rotation in the counter-clockwise direction in dependence upon which of the apertures 37 within which the detent pin becomes inserted when the short circuit current rating ring 33 is inserted within the second knob opening 21A. The limitation of rotation of the second knob 21 to correspondingly limit or set the short circuit ampere rating within the associated potentiometer 24 at the bottom thereof allows the same potentiometer to be used with a wide range of ampere ratings while adjustment thereof to set the short circuit rating is controlled by limiting the maximum value of the potentiometer to the maximum degree of rotation of the second knob 21.

Figure 3:
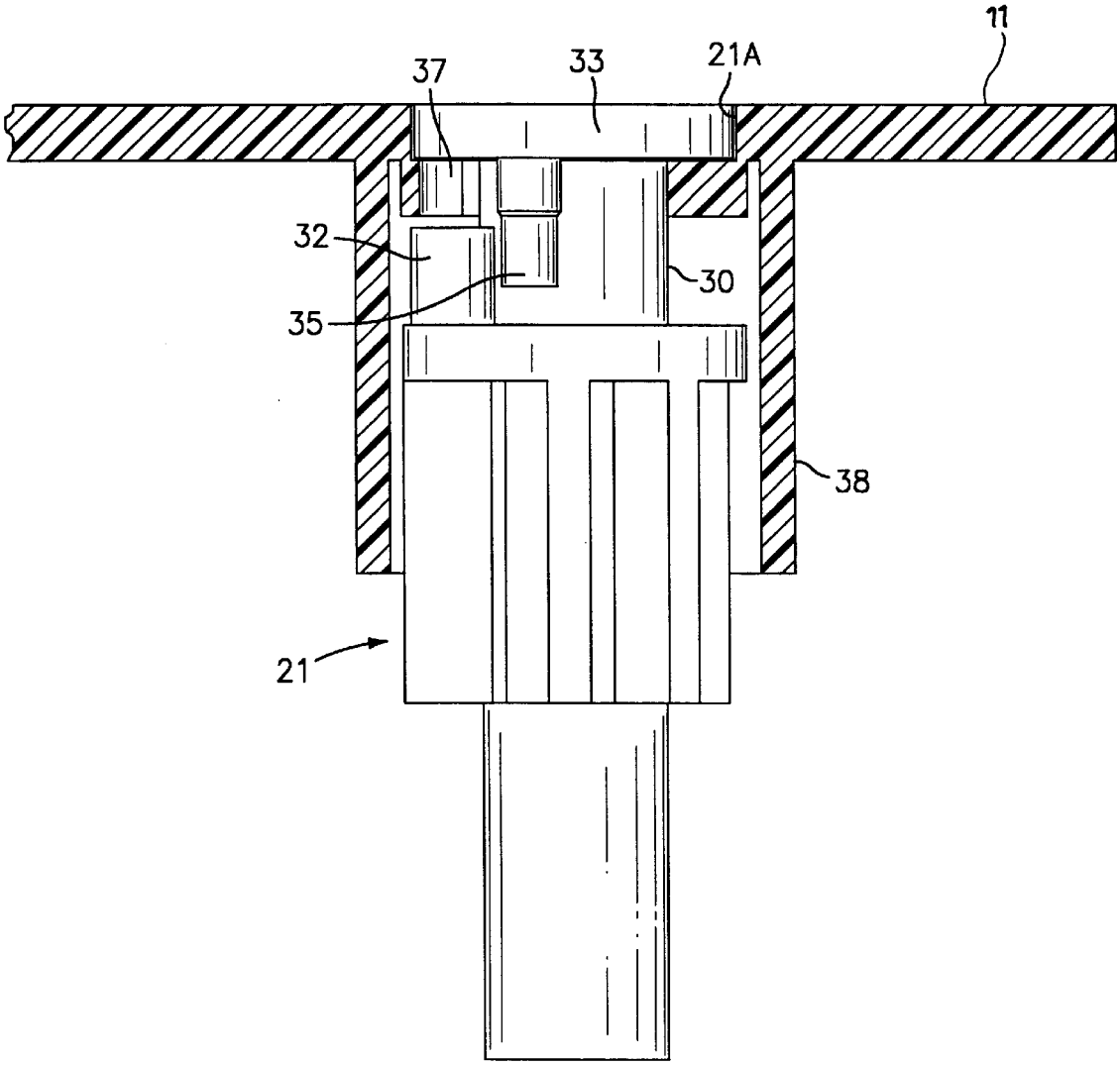
FIG. 3 is an enlarged cross section view of a part of the trip unit cover through the plane 3—3 of FIG. 1.

The interference between the post 32 on the knob stem 30 and the detent pin 35 on the short circuit current rating ring 33 is best seen by now referring to FIG. 3 wherein the second knob 21 is positioned within the cylinder 38 extending from the trip unit cover 11. When the knob stem 30 is rotated within the short circuit current rating ring 33, the entire second knob 21 rotates within the cylinder 38 until the post 32 formed on the knob stem strikes against the detent pin 35 to thereby limit the rotation of the second knob and the resulting value within the potentiometer 24 of FIG. 2 associated with the second knob.

Three such apertures 37 are depicted within the short circuit current rating ring 33 which allows up to four values of short circuit interruption current. Should lower or higher ranges be required, further apertures could be employed.

A circuit breaker trip unit having adjustable short circuit overcurrent ratings has herein been described whereby a common trip unit printed circuit board within a common trip unit enclosure can be employed over a wide range of short circuit ratings by factory-arrangement of a detent pin to limit the rotation of the short circuit rating knob and hence the value of the associated potentiometer to which the short circuit rating knob is attached.

What is claimed is:

1. A circuit breaker trip unit comprising:

a case and a cover;

a circuit breaker trip unit within said case, said trip unit including a potentiometer for setting circuit breaker ampere ratings;

a rotatable knob attached to said potentiometer for allowing external rotation of said knob by an operator; and detent means within said case said detent means interfering with said rotatable knob to thereby limit rotation of said knob and thereby set said circuit breaker ratings said rotatable knob defines a knob stem accessible from a top part of said cover and a bottom barrel interacting with said potentiometer, (The circuit breaker trip unit of claim 2 wherein) said rotatable knob further includes a flange intermediate said knob stem and said bottom barrel.

2. The circuit breaker trip unit of claim 1 further including a cylinder extending from an interior surface of said cover, said flange being captured within said cylinder.

3. The circuit breaker trip unit of claim 1 wherein said cover includes a cover opening defining a perimetric floor and a perimetric floor opening.

4. The circuit breaker trip unit of claim 3 including a rating ring positioned within said cover opening and arranged over said perimetric floor.

5. The circuit breaker trip unit of claim 4 wherein said knob stem extends within said perimetric floor opening.

6. The circuit breaker trip unit of claim 4 wherein said rating ring defines an annular ring having a ring opening therein and a detent pin extending therefrom.

7. The circuit breaker trip unit of claim 6 wherein said perimetric floor includes a plurality of detent apertures formed therein, whereby one of said apertures receives said detent pin when said rating ring is positioned within said cover opening.

8. The circuit breaker trip unit of claim 7 wherein said knob stem includes a post formed thereon, said post contacting said detent pin to thereby prevent complete rotation of said knob stem within said perimetric floor opening to thereby limit rotation of said flange, said bottom barrel and said potentiometer and limit said circuit breaker ampere rating.

9. The circuit breaker trip unit of claim 8 wherein said circuit breaker ampere rating comprises a short circuit ampere rating.

10. The circuit breaker trip unit of claim 3 wherein said cover further includes an indicator opening for receiving an indicator plug unit.

11. The circuit breaker trip unit of claim 3 wherein said cover further includes a rating plug opening for receiving a rating plug unit.

12. The circuit breaker trip unit of claim 1 wherein said potentiometer comprises a base and a base stem upstanding from said base and said barrel includes an elongated opening defined at one end, said base stem being captured within said elongated opening in press-fit relation.

13. The circuit breaker trip unit of claim 12 wherein said trip unit comprises a printed wire board, said base including terminals for connecting said potentiometer with said trip unit printed wire board.

* * * * *